US008257123B1

(12) United States Patent
Witham

(10) Patent No.: US 8,257,123 B1
(45) Date of Patent: Sep. 4, 2012

(54) QUADRIMANUAL FORWARD-ROWING DEVICE WITH SEMI-INDEPENDENT OARS

(75) Inventor: Tracy Don Witham, Sauk Rapids, MN (US)

(73) Assignee: Tracy D Witham, Sauk Rapids, MN (US)

( * ) Notice: Subject to any disclaimer, the term of this patent is extended or adjusted under 35 U.S.C. 154(b) by 249 days.

(21) Appl. No.: 12/587,267

(22) Filed: Oct. 5, 2009

(51) Int. Cl.
*B63H 16/00* (2006.01)
*B63H 16/04* (2006.01)
*B63H 16/10* (2006.01)

(52) U.S. Cl. ..... 440/104; 440/101

(58) Field of Classification Search ..... 440/21, 440/25, 32, 101, 102, 104, 106, 107, 108, 440/109, 110
See application file for complete search history.

(56) References Cited

U.S. PATENT DOCUMENTS

| | | | | |
|---|---|---|---|---|
| 3,330,245 | A * | 7/1967 | Klabunde | 440/102 |
| 3,340,844 | A * | 9/1967 | Fieldman | 440/25 |
| 3,404,414 | A * | 10/1968 | Goserud | 440/107 |
| 6,109,988 | A * | 8/2000 | Dunn, Jr. | 440/104 |
| 6,113,447 | A * | 9/2000 | Roy et al. | 440/102 |
| 6,817,913 | B1 | 11/2004 | Witham | |
| 2010/0035490 | A1 * | 2/2010 | Ninham et al. | 440/107 |

OTHER PUBLICATIONS www.powerlifting watch.com.
www.childlovski.net/liftup/.

* cited by examiner

*Primary Examiner* — Lars A Olson
*Assistant Examiner* — Anthony Wiest

(57) ABSTRACT

Disclosed is a device for facilitating direct arm-and-leg tandem (quadrimanual) production of the power stroke in forward-facing rowing that allows the placing of the oars into the water for the power strode and the clearing of the oars from the water in the recovery stroke to be done with the arms independently of the legs. Starboard side pivotable vertical axis (100 and port side pivotable vertical axis (11) provide the means for starboard side off-set pedal bar (4) and port side off-set pedal bar (5) to pivot in a horizontal dimension along with starboard side off-set oar (6) and port side off-set oar (7). By pushing forward on the off-set pedal bars and off-set oars denoted, one engages the power stroke in rowing the device. By moving said pedal bars and oars backward, one repositions the oars in the horizontal dimension during the recovery stroke for a subsequent power stroke. Starboard side pivotable horizontal axis (12) and port side pivotable horizontal axis (13) provide the means for starboard side off-set oar (6) and port side off-set oar (7) to pivot in the vertical dimension, independently of starboard side pedal bar (4) and port side pedal bar (5). By pushing up and down on said oars one positions them for the power and recovery strokes respectively.

1 Claim, 4 Drawing Sheets

QUADRIMANUAL FORWARD-ROWING DEVICE WITH SEMI-INDEPENDENT OARS

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

This invention pertains to rowed watercraft by facilitating direct arm-and-leg production of forward-facing rowing.

2. Prior Art

The invention disclosed herein improves U.S. Pat. No. 6,817,913 issued Nov. 16, 2004 to Tracy Don Witham. The Summary of Witham's 2004 patent states: "With a recumbent seat positioned relative to handle-and-pedal assemblies directly attached to oars in such a way that a rower can produce maximum power for rowing a watercraft, the present invention facilitates direct arm-and-leg tandem production of forward-facing rowing." But the Background to Witham's 2004 patent acknowledges a problem the invention faces: "downward motion of the attached oar pedal [which goes through substantially the same motion as the oar handle, but in a lower position] which [is] needed to swing the oar blade out of the water in the recovery phase of the rowing motion, would be blocked by the hull floor, unless the boat seat were raised, in which case [a small rowed] boat would become unstable . . . " For that reason the patent drawings for Witham's 2004 invention show it mounted on a catamaran whereby the pedals can swing between the two hulls, rather than into a hull floor. That limits the invention's marketability, since potential customers are likely to need catamaran hulls to use with the invention. Beyond adding a cost burden to potential customers of Witham's 2004 invention, pairing it with a suitable catamaran creates a large retail footprint, thereby creating a disincentive for retailers to stock the invention. Therefore, eliminating the reason making it necessary for a rower to move the pedals down for the recovery phase of the rowing motion constitutes an important improvement over U.S. Pat. No. 6,817,913.

SUMMARY

The prior art requires downward motion of the pedal bar. No prior art employs a strategy to eliminate the downward motion of pedal bars in a device that facilitates direct arm-and-leg-tandem, "quadrimanual," production of forward facing rowing.

DRAWINGS

Figures

Figure 1:
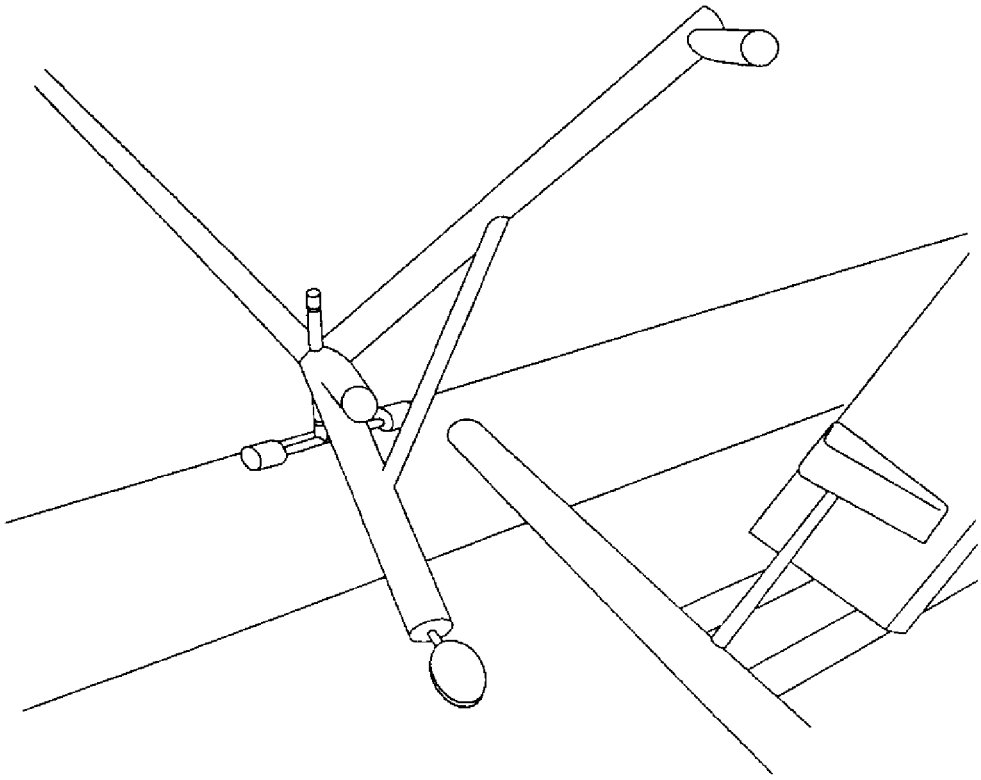
Prior Art Fig 1
FIG. 1 shows the prior art.

| DRAWINGS - Reference Numerals | |
|---|---|
| 1 | device |
| 2 | starboard side of device |
| 3 | port side of device |
| 4 | starboard side off-set pedal bar |
| 5 | port side off-set pedal bar |
| 6 | starboard side off-set oar |
| 7 | port side off-set oar |
| 8 | starboard side yoke |
| 9 | port side yoke |
| 10 | starboard side pivotable vertical axis |
| 11 | port side pivotable vertical axis |
| 12 | starboard side pivotable horizontal axis |
| 13 | port side pivotable horizontal axis |
| 14 | small watercraft for use with device |
| 15 | frame to hold device on watercraft |

DETAILED DESCRIPTION

Figure 2:
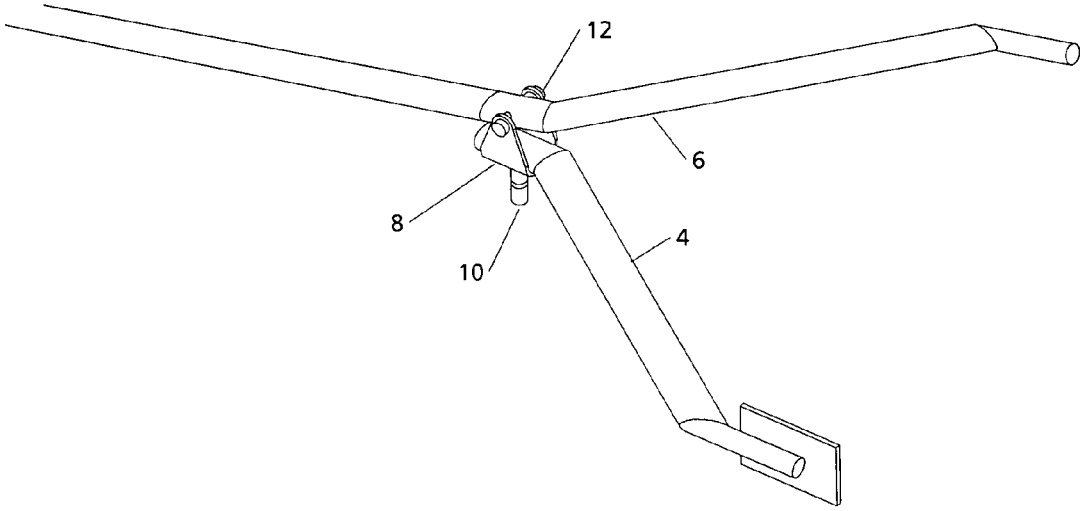
FIG. 2 is a perspective drawing of the starboard side of the present invention from a point of view above and to the inboard side of the invention. It depicts all components essential to the present invention on the starboard side.
Figure 3:
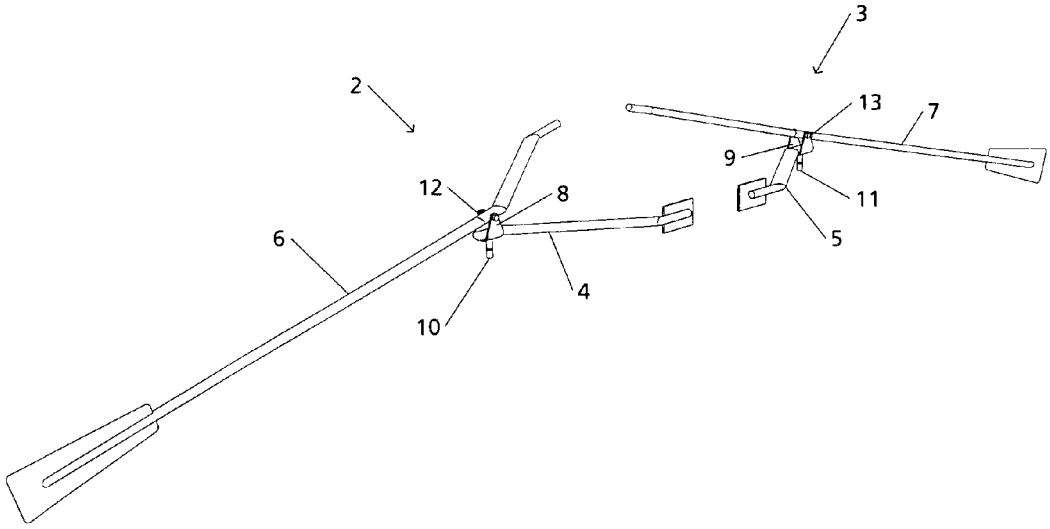
FIG. 3 is a perspective drawing showing the starboard and port sides of the present invention, showing the starboard and port sides to be comprised of exactly the same components, differing only in that the starboard and port aides form mirror images of each other.
Figure 4:
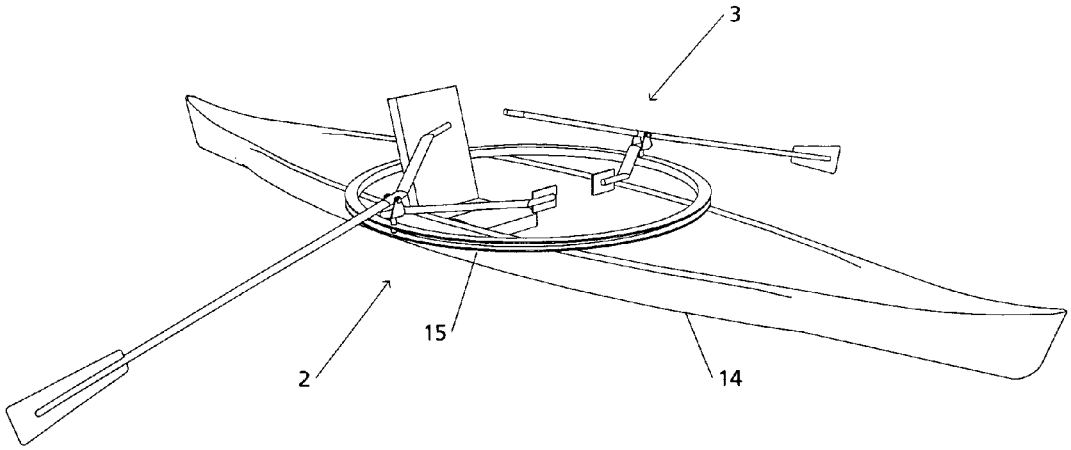
FIG. 4 shows the present invention as it might look mounted on a small manual watercraft. The watercraft and mounting frame on which the present invention is depicted are not part of the present invention, but are included in FIG. 4 to provide an illustrated context for understanding how the present invention is to be used.

FIGS. 2-4—Preferred Embodiment

To understand this description fully, it should be read with FIGS. 2-4 in view. In referring to this invention and the parts which it comprises, the reference numerals provided shall be used throughout the following description. I begin with FIG. 2. There depicted is a perspective view of the starboard side of the present invention, starboard side of device 2, as seen from above to the forward and inboard side. The preferred embodiment of starboard side of device 2 comprises these essential components: starboard side off-set pedal bar 4, starboard side off-set oar 6, starboard side yoke 8, starboard side pivotable vertical axis 120, and starboard side pivotable horizontal axis 12.

Because starboard side off-set pedal bar 4 attaches directly to starboard side yoke 8, which pivots on starboard side pivotable vertical axis 10, starboard side off-set pedal bar 4 pivots exclusively in a horizontal plane along with starboard side yoke 8. But because starboard side off-set pedal bar 4 is not connected to starboard side pivotable horizontal axis 12, starboard side off-set pedal bar 4 cannot pivot by means of starboard side pivotable horizontal axis 12 in a vertical dimension along with starboard side off-set oar 6, which does pivot in a vertical dimension by means of starboard side pivotable horizontal axis 12. It is this semi-independence of starboard side off-set oar 6 with respect to starboard side off-set pedal bar 4 that effects the improvement (on starboard side of device 2) claimed for the present invention. For it is by means of this semi-independence that starboard side off-set pedal bar 4 pivots in the horizontal dimension exclusively in conjunction with starboard side off-set oar 6, while starboard side off-set oar 6 pivots in a vertical dimension as well, independently of starboard side off-set pedal bar 4.

FIG. 3 shows the preferred embodiment of the present invention, device 1, comprising starboard side of device 2 and its components just described and enumerated in the above paragraph, which explained FIG. 2, and port side of device 3, which comprises all of the same components as are described in FIG. 2 above, except that they are aligned to the port side in an exact mirror image of the starboard side and assigned separate reference numerals as follows: poet side off-set pedal bar 5, port side off-set oar 7, port side yoke 9, port side pivotable vertical axis 11, and port side pivotable horizontal axis 13. The same reason given above for the semi-independence of starboard side off-set pedal bar 4 relative to starboard side off-set oar 6 pertains with respect to port side off-set pedal bar 5 and port side off-set oar 7. Accordingly, when one understands starboard side of device 2, one also understands port side of device 3, since the starboard and port sides are used in tandem to produce direct quadrimanual forward rowing. And since starboard side of device 2 and port side of device 3 encompass all of device 1, the preferred embodiment of the present invention, one understands the present invention.

Operation—FIGS. 2 and 3

From the description above it is apparent that the present invention employs a strategy to pivot its starboard side off-set pedal bar 4 and its port side off-set pedal bar 5 only in the fore-and-aft dimension. This allows a rower to push the pedal bars forward during the power stroke of the rowing motion and pull them aft during the recovery portion of the rowing motion. It is also apparent that starboard side off-set oar 6 and port side off-set oar 7 pivot independently of starboard side off-set pedal bar 4 and port side off-set pedal bar 5 in a basically vertical plane for the purpose of setting the oars in the proper position for the power stroke and recovery stroke portions of the rowing motion.

ADVANTAGES

The present invention allows for movement of the pedals with the oars in the fore-and-aft orientation, as does the prior art. But it does not allow for the movement in the up-and-down dimension, thereby eliminating the downward motion of the pedals. Thus, a rower of the present invention no longer needs to sit higher than would otherwise be necessary to row a direct quadrimanual forward-rowing device in a small, mono-hulled watercraft, such as a canoe or row boat. Consequently, a catamaran is no longer typically needed, and associated disincentives to buy and sell the device—the increased cost and larger retail footprint—have been eliminated. As a secondary benefit, the device becomes more efficient to row, since movement unproductive to directly producing propulsion has been eliminated for a rower's legs.

In short and to recap, the present invention eliminates the downward motion of the pedal bars in the coordinated action of a rower's arms and legs in rowing a direct quadrimanual forward-rowing device, producing the following advantages.

(a) the device can be mounted on small single-hulled boats, such as many persons already own and many retailers already stock, without compromising the small manual watercraft's stability, and (b) the device provides a design solution that eliminates unnecessary leg motion while rowing a direct quadrimanual forward rowing device, thereby making the rowing more efficient.

CONCLUSION, RAMIFICATIONS, AND SCOPE

The present invention comprises a set of components that will be familiar to adults generally, both inside and outside of the arts relevant to its making. Indeed, the first yoked axle connected to a pivotable component is as old as the first wheeled conveyance, which is to say, it dates to times immemorial. And the first axles attached to the same divide that allowed components attached to the axles to pivot independently of each other is as old as the first double-axled wheeled conveyance. But the present invention is, in its improvement over the prior art, just a conjunction of components to two sets of axles in a way that allows the components to pivot in unison in one dimension, the horizontal, and separately in a second dimension, the vertical. The means to achieving the essential improvement over the prior art for the present invention, therefore, date to time before recorded history. Moreover, the means essential to achieving the improvement over the prior art—axles allowing for connected members to pivot in unison and independently—are ubiquitous both in the sense of being very common and ranging over a very wide variety of devices and uses and styles. Therefore, to understand the present invention, one must conceive of its novelty in the abstract as a surprising new use of old, familiar, and common components. Therefore, FIGS. 2 and 3 above, along with the descriptions of them, should not be construed as limiting the scope of the embodiments, but rather as just illustrating the preferred embodiment.

A specific example will help. A welder fabricating the present invention could look down at the wheels attached to castors on the cart that holds his welding equipment. There he or she would see the same components crucial to achieving the improvement of the present invention over the prior art: one axis connected to a yoke that pivots in a horizontal dimension and another connected to an axis that allows a connected member to pivot in a vertical dimension, so that the horizontal axis and its attached member can pivot semi-independently of the vertical axis and yoke. Now suppose that the vertical axis is functionally real but comprised of round bearings that turn in circular depressions mirroring each other in opposing flat surfaces, just as is commonly found with castors. To a fabricator who has become familiar with the present invention it would be obvious that, if suitable in size, strength, weight, etc., his welding cart could supply the essential components, minus the off-set oars and pedalbars, for implementing the improvements of the present invention.

Several ramifications can be drawn. (1) Familiar components, not depicted in the preferred embodiment of the present invention, that function in the way crucial to the present invention's improvement over the prior art will be obvious in light of the present invention, and so cannot be considered innovative. (2) Familiar components that function in the way crucial to the present invention's improvement over the prior art will be obvious only after a person becomes familiar with the present invention, and so will depend on the innovation of the present invention. And (3) familiar components which set up functional equivalents of components cited where the functional equivalents only embody the equivalents by way of abstraction, as in our example, in which bearings move in recessed circles around an entirely real albeit entirely abstract center axis.

It should also be noted that either the off-set oars or the off-set pedals depicted in the preferred embodiment could have been rendered straight (not off-set) or straighter (less off-set). The reason that they are both depicted as off-set by the same distance is so that they move together through arcs in the horizontal dimension which are equidistant from an imaginary line projected inboard from the outboard side of the oar shaft. By making the arcs equidistant in this way, the off-set handles and pedals avoid unnecessarily wide splaying of a rower's arms or legs when rowing a direct quadrimanual forward rowing device. That is preferred. Yet a straight (not off-set) handle or pedal could be mounted on a direct quadrimanual forward rowing device at a detriment to a rower in a facile attempt to make it appear that the device is not a copy of the present invention. Clearly, introducing such a deficiency into a device does not constitute an innovation, and does not hide such a device's copying of the present invention.

To conclude, (1) using familiar means to set up semi-independent axes connected to yokes, pedals, and oars, fails the test of patentability in that such familiar means become obvious in light of the present invention, in which case using familiar functional substitutes for components claimed below constitutes jerry-built copies of the present invention, and (2) minor changes or adaptations to the familiar components claimed below cannot be considered innovative unless they effect an improvement over the present invention. In short, the present invention innovates through a novel use of familiar components, and any use of familiar components to make the present invention by means of obvious and well known functional substitutes, as in the example, must be judged to fail. Accordingly, it is the appended claim which should determine the scope of the present invention, and not the particular form of the preferred embodiment depicted in the Figs or their descriptions given above.

I claim:

1. An improvement to direct quadrimanual forward-rowing devices which constrain one's arms and legs to move in tandem throughout the rowing motion in which the improvement facilitates semi-independent use of one's arms in rowing a direct quadrimanual forward-rowing device, wherein the improvement comprises:

(a) a starboard side of device comprised of (b) a starboard side off-set pedal bar aligned inboard of (c) a starboard side pivotable vertical axis by means of which the starboard side off-set pedal bar pivots fore and aft in a substantially horizontal dimension, said starboard side off-set pedal bar being connected to (d) a starboard side yoke holding (e) a starboard side pivotable horizontal axis by means of which (f) a starboard side off-set oar pivots up and down in a substantially vertical dimension, and (g) a port side of device comprised of a mirror image alignment of the components just described as comprising the starboard side of device and in conjunction with the starboard side of device components the port side of device comprises the improvement claimed herein, whereby one can row from a recumbent position using direct arm-and-leg tandem production of the alternating power and recovery strokes in the fore and aft dimension but using one's arms independently of one's legs to move the oars up and down into appropriate positions for the alternating power and recovery strokes.

* * * * *